US007914962B2

(12) United States Patent
Wu

(10) Patent No.: US 7,914,962 B2
(45) Date of Patent: Mar. 29, 2011

(54) LIGHT STABILIZER CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 879 days.

(21) Appl. No.: 11/848,417

(22) Filed: Aug. 31, 2007

(65) Prior Publication Data

US 2009/0061336 A1 Mar. 5, 2009

(51) Int. Cl.
*G03G 5/00* (2006.01)

(52) U.S. Cl. ..... 430/59.1; 430/59.4; 430/59.5

(58) Field of Classification Search ..... 430/59.1, 430/59.4, 59.5

See application file for complete search history.

(56) References Cited

U.S. PATENT DOCUMENTS

| | | | | |
|---|---|---|---|---|
| 4,921,769 | A | 5/1990 | Yuh et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 5,688,621 | A * | 11/1997 | Takegawa et al. | 430/64 |
| 6,913,863 | B2 | 7/2005 | Wu et al. | |
| 2005/0089789 | A1 * | 4/2005 | Zhu | 430/126 |
| 2005/0161865 | A1 * | 7/2005 | Bristow et al. | 264/511 |
| 2006/0105254 | A1 | 5/2006 | Wu et al. | |

FOREIGN PATENT DOCUMENTS

| | | | |
|---|---|---|---|
| JP | 2006-64954 | * | 3/2006 |

OTHER PUBLICATIONS

Jin Wu et al., U.S. Appl. No. 11/472,765 on Titanyl Phthalocyanine Photoconductors, filed Jun. 22, 2006.

Jin Wu et al., U.S. Appl. No. 11/472,766 on Titanyl Phthalocyanine Photoconductors, filed Jun. 22, 2006.

Liang-Bih Lin et al., U.S. Appl. No. 11/800,108 on Photoconductors, filed May 4, 2007.

Liang-Bih Lin et al., U.S. Appl. No. 11/800,129 on Photoconductors, filed May 4, 2007.

* cited by examiner

*Primary Examiner* — Mark A Chapman

(74) *Attorney, Agent, or Firm* — Oliff & Berridge, PLC

(57) ABSTRACT

A photoconductor comprising a supporting substrate, a photogenerating layer, and at least one charge transport layer comprised of at least one charge transport component, and wherein said photogenerating layer contains a light stabilizer.

29 Claims, No Drawings

LIGHT STABILIZER CONTAINING PHOTOCONDUCTORS

CROSS REFERENCE TO RELATED APPLICATIONS

U.S. application Ser. No. 11/848,454, U.S. Publication No. 20090061340, entitled Hydroxy Benzophenone Containing Photoconductors by Liang-Bih Lin et al., filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a hydroxyalkoxy benzophenone.

U.S. application Ser. No. 11/848,428, U.S. Publication No. 20090061337, entitled Photoconductors by Jin Wu et al., filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein said photogenerating layer contains a triazine.

U.S. application Ser. No. 11/848,439, now U.S. Pat. No. 7,670,738, entitled Boron Containing Photoconductors by Jin Wu, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein said photogenerating layer contains a boron compound.

U.S. application Ser. No. 11/848,448, now U.S. Pat. 7,785,758, entitled Triazole Containing Photoconductors by Jin Wu, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein said photogenerating layer contains a triazole.

U.S. application Ser. No. 11/800,108, now U.S. Pat. No. 7,662,526, filed May 4, 2007 by Liang-Bih Lin et al. on Photoconductors, the disclosure of which is totally incorporated herein by reference, illustrates a photoconductor comprising a supporting substrate, a photogenerating layer, and at least one charge transport layer comprised of at least one charge transport component, and wherein the charge transport layer contains a benzoimidazole.

U.S. application Ser. No. 11/800,129, U.S. Publication No. 20080274419, filed May 4, 2007 by Liang-Bih Lin et al. on Photoconductors, the disclosure of which is totally incorporated herein by reference, illustrates a photoconductor comprising a supporting substrate, a photogenerating layer, and at least one charge transport layer comprised of at least one charge transport component, and wherein the photogenerating layer contains a bis(pyridyl)alkylene.

In U.S. application Ser. No. 11/472,765, now U.S. Pat. No. 7,553,593, filed Jun. 22, 2006, and U.S. application Ser. No. 11/472,766, now U.S. Pat. No. 7,485,398, filed Jun. 22, 2006, the disclosures of which are totally incorporated herein by reference, there are disclosed, for example, photoconductors comprising a photogenerating layer and a charge transport layer, and wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene.

High photosensitivity titanyl phthalocyanines are illutrated in copending U.S. application Ser. No. 10/992,500, U.S. Publication No. 20060105254, the disclosure of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross referenced applications, such as the supporting substrates, resin binders, antioxidants, charge transport components, titanyl phthalocyanines, high photosensitivity titanyl phthalocyanines, such as Type V, hole blocking layer components, adhesive layers, and the like, may be selected for the photoconductor and imaging members of the present disclosure in embodiments thereof.

BACKGROUND

This disclosure is generally directed to layered imaging members, photoreceptors, photoconductors, and the like. More specifically, the present disclosure is directed to multilayered drum, or flexible, belt imaging members, or devices comprised of a supporting medium like a substrate, a photogenerating layer, and a charge transport layer, including at least one or a plurality of charge transport layers, and wherein at least one is, for example, from 1 to about 7, from 1 to about 3, and one; and more specifically, a first charge transport layer and a second charge transport layer, and wherein the photogenerating layer includes a component that results in photoconductors with a number of advantages, such as acceptable charge deficient spots (CDS). More specifically, there is disclosed herein photoconductors that contain an additive or dopant in the photogenerating layer, thereby permitting, for example, excellent reduced charge deficient spot (CDS) characteristics, and improved cyclic stability properties. Although not desiring to be limited by theory, it is believed that the additives, such as triazines, the light stabilizers or the boron containing compounds possess electron conduction capability which assists in moving negative charges from the photogenerating layer thereby reducing the CDS counts.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468 wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, hydrolyzing said pigment precursor chlorogallium phthalocyanine Type I by standard methods, for example acid pasting, subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer.

The appropriate components, such as the supporting substrates, the photogenerating layer components, the charge transport layer components, the overcoating layer components, and the like of the above-recited patents, may be selected for the photoconductors of the present disclosure in embodiments thereof.

SUMMARY

Disclosed are photoconductors that contain a dopant in the photogenerating layer thereby permitting excellent reduced charge deficient spot (CDS) characteristics.

Further, disclosed are photoconductors comprised of suitable additive containing photogenerating layers, and where in embodiments the photogenerating layer further contains a photogenerating pigment or pigments, such as high photosensitivity titanyl phthalocyanine.

Additionally disclosed are flexible belt imaging members containing optional hole blocking layers comprised of, for example, amino silanes, metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

The photoconductors illustrated herein, in embodiments, have excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the imaging members disclosed herein possess excellent, and in a number of instances low $V_r$ (residual potential), and allow the substantial prevention of $V_r$ cycle up when appropriate; high sensitivity; low acceptable image ghosting characteristics; low background and/or minimal charge deficient spots (CDS); and desirable toner cleanability. At least one in embodiments refers, for example, to one, to from 1 to about 10, to from 2 to about 7, to from 2 to about 4, to two, and the like.

EMBODIMENTS

Aspects of the present disclosure relate to a photoconductor comprising a supporting substrate, a photogenerating layer comprised of at least one photogenerating pigment, and an additive, and at least one charge transport layer comprised of at least one charge transport component; a flexible photoconductive member comprised in sequence of a supporting substrate, a photogenerating layer thereover comprised of at least one photogenerating pigment, and an additive that assists in achieving photoconductors with minimal charge deficient spots and a protective top overcoating layer; and a photoconductor which includes a hole blocking layer and an adhesive layer where the adhesive layer is situated between the hole blocking layer and the photogenerating layer, and the hole blocking layer is situated between the substrate and the adhesive layer; a photoconductor comprising a supporting substrate, a photogenerating layer, and at least one charge transport layer comprised of at least one charge transport component, and wherein the photogenerating layer contains a light stabilizer; a photoconductor comprised in sequence of a supporting substrate, a photogenerating layer comprised of at least one photogenerating pigment and a substituted amine oligomer represented by the following formulas/structures

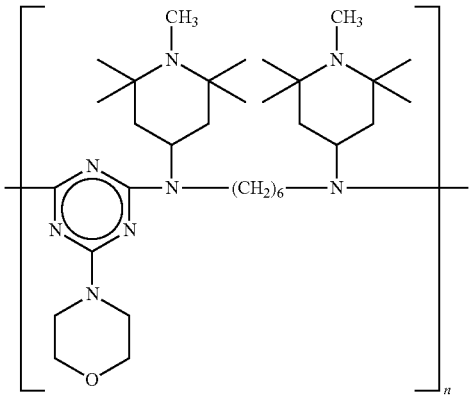

-continued

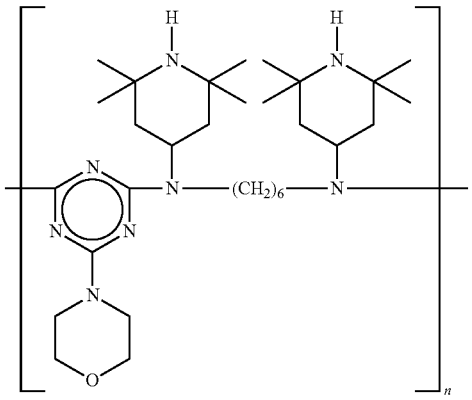

and a charge transport layer, and wherein n represents the number of segments, and is, for example, a number of from 1 to about 100, from 1 to about 50, from 1 to about 25, from 2 to about 25, from 2 to about 15, from 1 to about 10, and from 2 to about 10; a photoconductor comprising a supporting substrate, a photogenerating layer, and a hole transport layer, and wherein the photogenerating layer comprises a high sensitivity titanyl phthalocyanine and a substituted amine oligomers, and wherein the substituted amine oligomer is present in an amount of from about 1 to about 10 weight percent; a photoconductor comprising a supporting substrate, a photogenerating layer, and at least one charge transport layer comprised of at least one charge transport component, and wherein the photogenerating layer contains a triazine; a photoconductor comprised in sequence of a supporting substrate, a photogenerating layer comprised of at least one photogenerating pigment and an electron transporting triazine, and a charge transport layer; and a photoconductor comprising a supporting substrate, a photogenerating layer, and a hole transport layer; and wherein the photogenerating layer comprises a high sensitivity titanyl phthalocyanine and 2,4-bis(2,4-dimethylphenyl)-6-(2-hydroxy-4-n-octyl-oxyphenyl)-1,3,5-triazine, and wherein the triazine is present in an amount of from about 1 to about 7 weight percent.

Examples of photogenerating layer additives present in various suitable amounts, such as from about 0.1 to about 25, about 0.5 to about 15, about 1 to about 10 weight percent based on the weight percentage of the photogenerating layer components include electron transporting components, such as nitrogen heterocyclic compounds, like triazines, and more specifically, 2,4-bis(2,4-dimethylphenyl)-6-(2-hydroxy-4-n-octyl-oxyphenyl)-1,3,5-triazine (CYASORB® UV-1164 from CYTEC), 2,4,6-tris[di(2-pyridyl)amino]-1,3,5-triazine, 2,4,6-tris(carbazolyl)-1,3,5-triazine, 2,4,6-tris[phenyl(2-naphthanyl)amino]-1,3,5-triazine, 2,4,6-tris[phenyl(1-naphthanyl)amino]-1,3,5-triazine, 2,4,6-tris{4-[di(2-pyridyl)amino]phenyl}-1,3,5-triazine, 1,3,5-triazine, 2,4,6-tri(4-pyridyl)-1,3,5-triazine, 2,4,6-tri(2-pyridyl)-1,3,5-triazine, 2,4,6-tris[bis(methoxymethyl)amino]-1,3,5-triazine, 2,4-diamino-6-[2-(2-undecyl-1-imidazolyl)ethyl]-1,3,5-triazine, 3,4-dihydro-4-oxo-1,2,3-benzotriazine, 5,6-diphenyl-3-(2-pyridyl)-1,2,4-triazine, 3-amino-5,6-dimethyl-1,2,4-triazine, respectively represented by the following formulas/structures

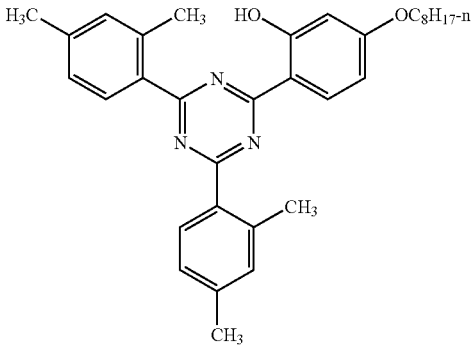
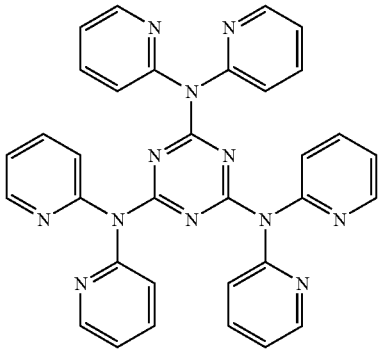
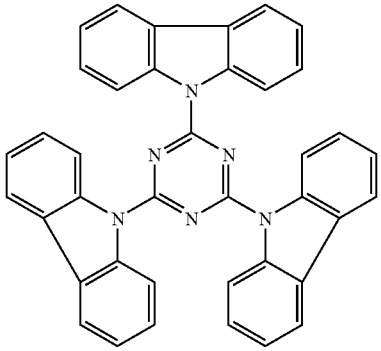
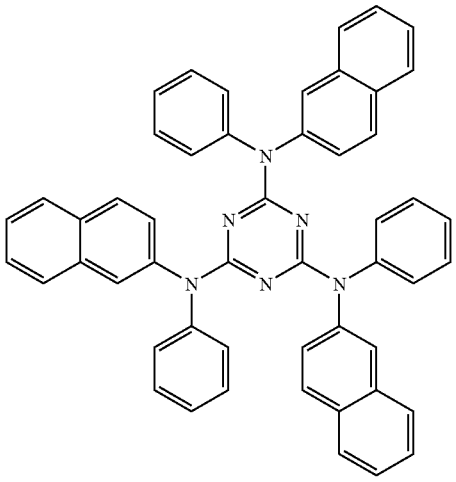
-continued
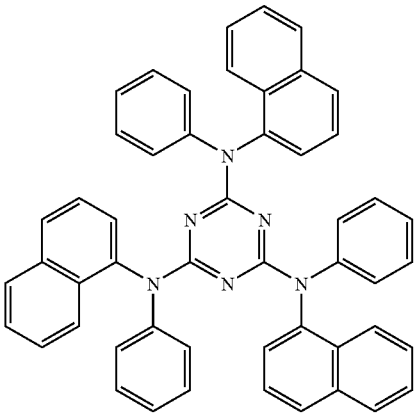
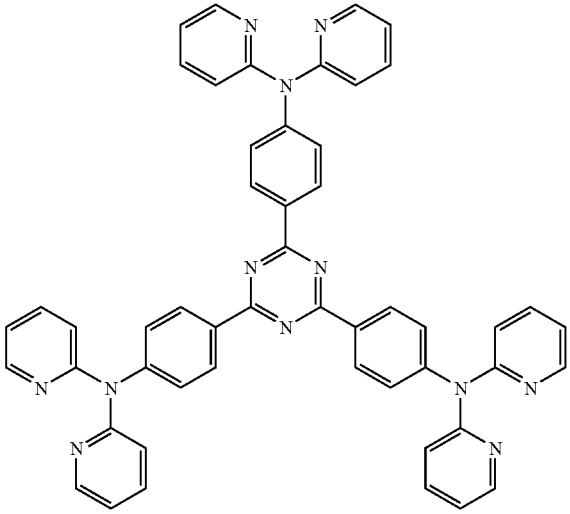
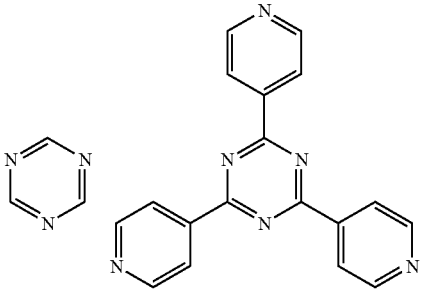
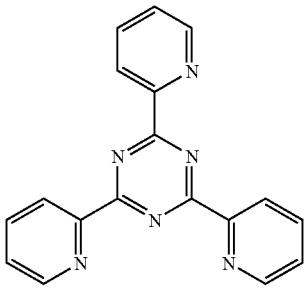
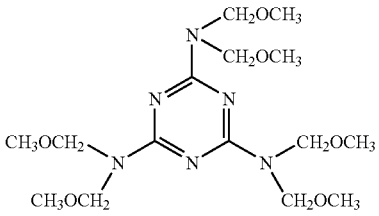

-continued

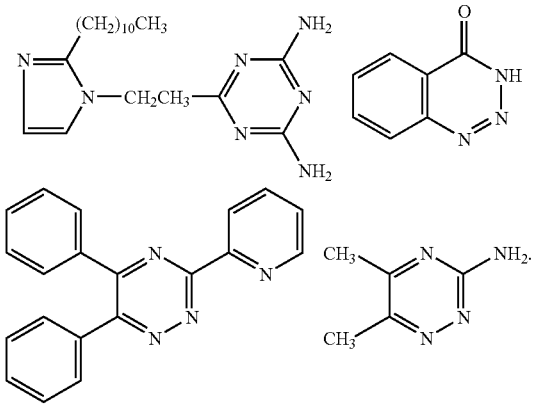

In embodiments, there are included in the photogenerating layer present in various suitable amounts, such as from about 0.1 to about 25, about 0.5 to about 15, about 1 to about 10 weight percent based on the weight percentage of the photogenerating layer components, light stabilizers, such as substituted amine oligomers, benzoxazinones, and pyrazines.

Specific examples of substituted amine oligomers include polymers containing, for example, morpholine-2,4,6-trichloro-1,3,5-triazine, 1,6-hexanediamine, N,N'-bis(2,2,6,6-tetramethyl-4-piperidinyl)-(CYASORB® UV-3529, $M_w$~1,700 and n~3, Tg~88° C.) and [(6-morpholino-s-triazine-2,4-diyl)[(2,2,6,6-tetramethyl-4-piperidyl)imino]-hexamethylene[(2,2,6,6-tetramethyl-4-piperidyl)imino]] (CYASORB® UV-3346, $M_w$~1,600 and n~3), such as those as represented by the following formulas/structures

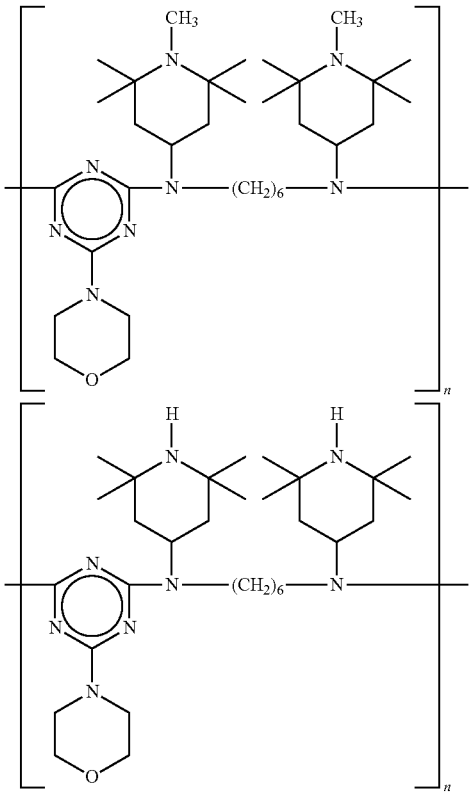

wherein n represents the number of repeating segments, and is, for example, a number of from about 1 to about 100, from about 2 to about 30, or from about 3 to about 10.

Specific examples of benzoxazinones include 2-(2-benzoylphenyl)-4H-3,1-benzoxazinone and 2-(4-biphenylyl)-4H-3,1-benzoxazinone, respectively represented by the following formulas/structures

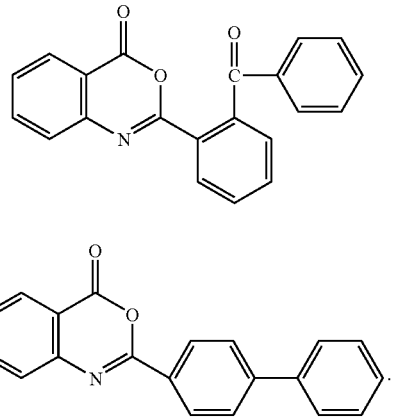

Specific examples of pyrazines include 2,3,5,6-tetra(2-pyridyl)pyrazine and 1,3,5-tris(3-phenylquinoxalin-2-yl)benzene, respectively represented by the following formulas/structures

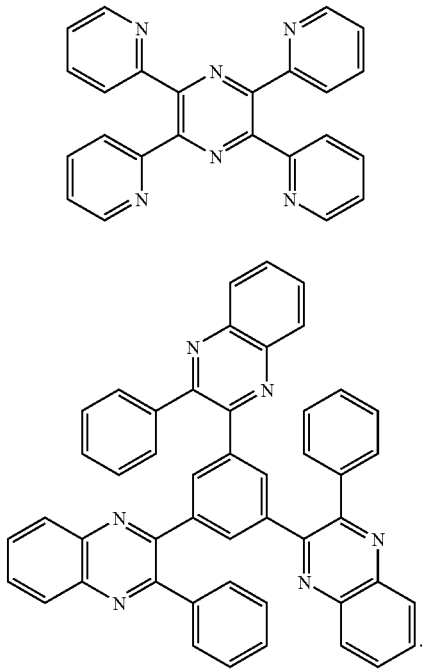

In embodiments, there are included in the photogenerating layer present in various suitable amounts, such as from about 0.1 to about 25, about 0.5 to about 15, about 1 to about 10 weight percent based on the weight percentage of the photogenerating layer components, boron containing compounds such as borates, boranes, and boron containing complexes.

Specific examples of borates include triethanolamine borate, triethyl borate, 2,4,6-trimethoxyboroxin, 2-isopropoxy-4,4,5,5-tetramethyl-1,3,2-dioxaborolane, 2,6-dimethyl-4-(4,4,5,5-tetramethyl-1,3,2-dioxaborolan-2-yl)phenol, bis(hexylene glycolato)diboron, respectively represented by the following formulas/structures

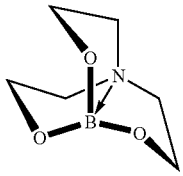

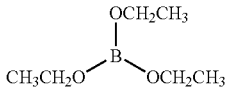

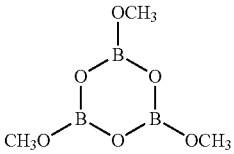

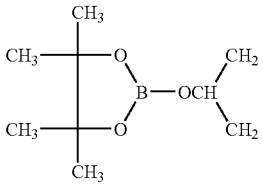

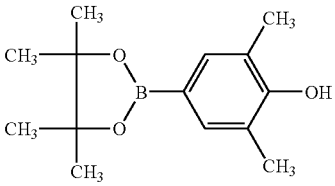

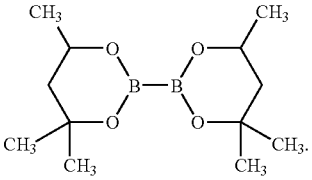

Specific examples of boranes include tris(2,3,5,6-tetramethylphenyl)borane, tris(2,3,5,6-tetramethylbiphenyl-4-yl)borane, tris(2,3,5,6-tetramethyl-1,1':4',1"-terphenyl-4-yl)borane, tris[2,3,5,6-tetramethyl-4-(1,1':3', 1"-terphenyl-5'-yl)phenyl]borane, 2,5-bis(dimesitylboryl)thiophene (n=1), 5,5'-bis(dimesitylboryl)-2,2'-bithiophene (n=2), 5,5"-bis(dimesitylboryl)-2,2':5',2"-terthiophene (n=3), 1,3,5-tris[5-(dimesitylboryl)thiophen-2-yl]benzene, respectively represented by the following formulas/structures

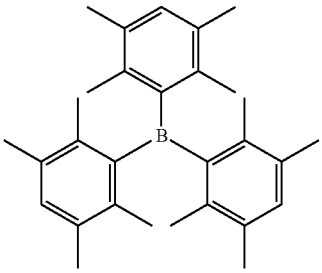

-continued

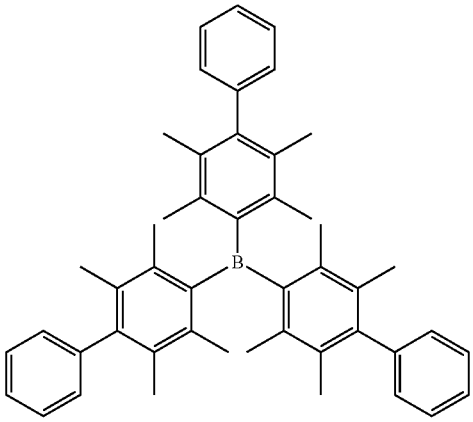

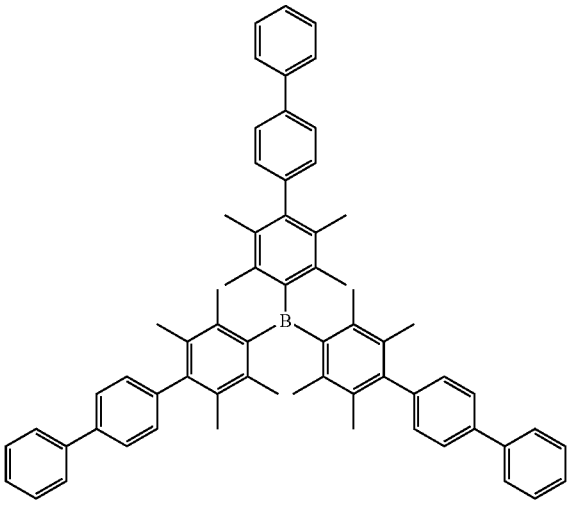

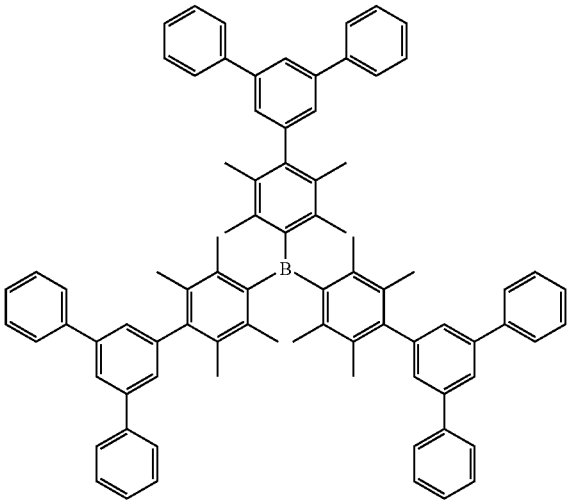

-continued

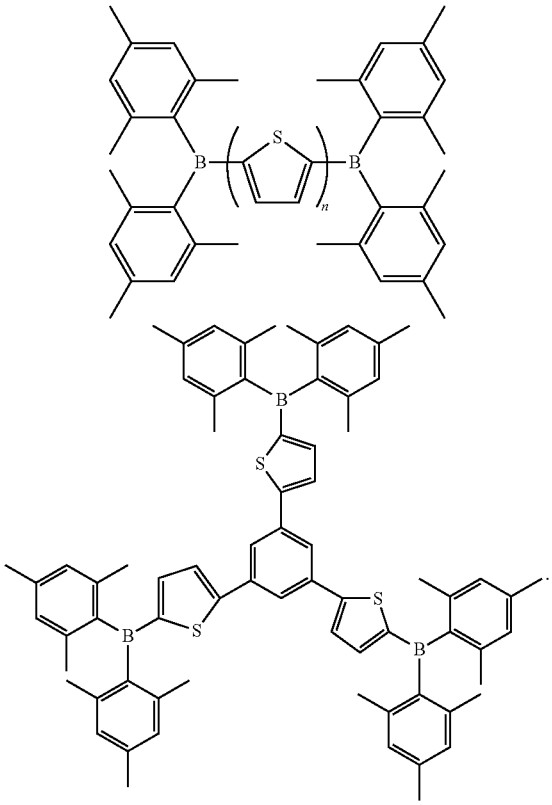

Specific examples of boron containing complexes include (8-quinolinolato)diphenylborane and (8-quinolinolato)-bis (2-benzothienyl)borane, respectively represented by the following formulas/structures

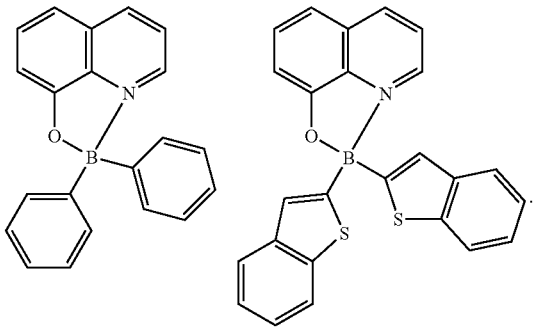

The thickness of the photoconductor substrate layer depends on many factors, including economical considerations, electrical characteristics, adequate flexibility, availability, and cost of the specific components for each layer, and the like, thus this layer may be of a substantial thickness, for example about 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 microns to about 300 microns, or from about 100 to about 150 microns.

The photoconductor substrate may be opaque or substantially transparent and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer and a charge transport layer or plurality of charge transport layers is formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than or equal to about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 40 microns. Examples of charge transport components are aryl amines of the following formulas/structures

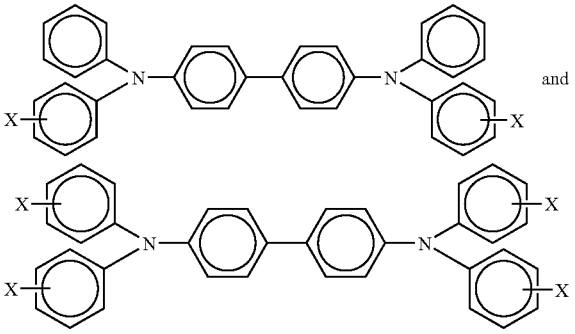

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

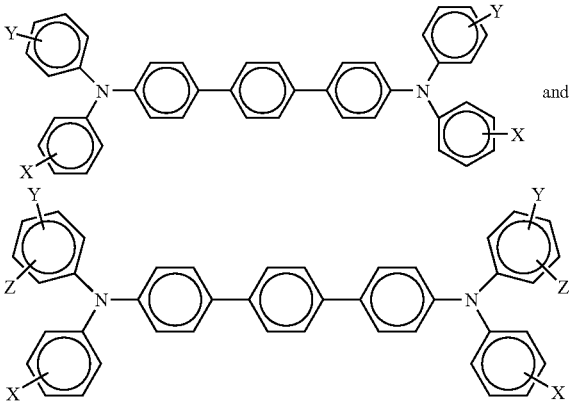

and wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene) carbonate (also referred to as bisphenol-A-polycarbonate), poly(4,4'-cyclohexylidine-diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis (4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional overcoating may be applied over the charge transport layer to provide abrasion protection.

Aspects of the present disclosure relate to a photoconductive imaging member comprised of a supporting substrate, an additive containing photogenerating layer, a charge transport layer, and an overcoating charge transport layer; a photoconductive member with a photogenerating layer of a thickness of from about 0.1 to about 10 microns, and at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of an ACBC (anticurlback coating) layer, a supporting substrate, and thereover a layer comprised of an additive and a photogenerating pigment, and a charge transport layer or layers, and thereover an overcoating charge transport layer, and where the transport layer is of a thickness of from about 40 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a titanyl phthalocyanine or a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

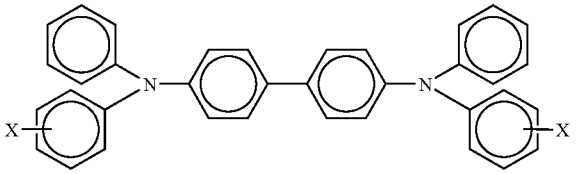

wherein X is selected from the group consisting of alkyl, alkoxy, aryl, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

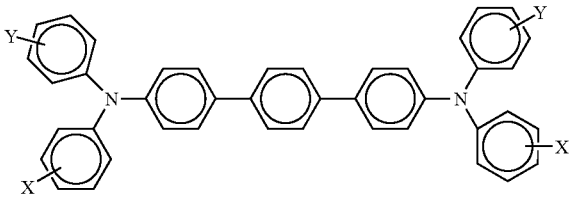

wherein X and Y are independently alkyl, alkoxy, aryl, a halogen, or mixtures thereof; an imaging member wherein alkyl and alkoxy contain from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta +/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, Type V titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; a photoconductor wherein the photogenerating layer contains an alkoxygallium phthalocyanine; photoconductive imaging members comprised of a supporting substrate, a photogenerating layer, a hole transport layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer.

The following Examples are being submitted to illustrate embodiments of the present disclosure. The light stabilizer can generally be classified as substituted amine oligomers, benzoxazinones, and pyrazines.

EXAMPLE I

Preparation of Type I Titanyl Phthalocyanine:

A Type I titanyl phthalocyanine (TiOPc) was prepared as follows. To a 300 milliliter three-necked flask fitted with mechanical stirrer, condenser, and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of tetrahydronaphthalene and 7.11 grams (0.025 mole) of titanium tetrapropoxide (all obtained from Aldrich Chemical Company except phthalonitrile which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter, M-porosity sintered glass funnel, which had been preheated with boiling dimethyl formamide (DMF). The solid Type I TiOPc product resulting was washed with two 150 milliliter portions of boiling DMF, and the filtrate, initially black, became a light blue-green color. The solid was slurried in the funnel with 150 milliliters of boiling DMF and the suspension was filtered. The resulting solid was washed in the funnel with 150 milliliters of DMF at 25° C., and then with 50 milliliters of methanol. The resultant shiny purple solid was dried at 70° C. overnight to yield 10.9 grams (76 percent) of pigment, which were identified as Type I TiOPc on the basis of their X-ray powder diffraction trace. Elemental analysis of the product indicated C, 66.54; H, 2.60; N, 20.31; and Ash ($TiO_2$), 13.76. TiOPc requires (theory) C, 66.67; H, 2.80; N, 19.44; and Ash, 13.86.

A Type I titanyl phthalocyanine can also be prepared in 1-chloronaphthalene or N-methylpyrrolidone as follows. A 250 milliliter three-necked flask fitted with mechanical stirrer, condenser and thermometer maintained under an atmosphere of argon was charged with 1,3-diiminoisoindolene (14.5 grams), titanium tetrabutoxide (8.5 grams), and 75 milliliters of 1-chloronaphthalene (CINP) or N-methylpyrrolidone. The mixture was stirred and warmed. At 140° C. the mixture turned dark green and began to reflux. At this time, the vapor (which was identified as n-butanol by gas chromatography) was allowed to escape to the atmosphere until the reflux temperature reached 200° C. The reaction was maintained at this temperature for two hours then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which were identified as Type I TiOPc by X-ray powder diffraction (XRPD).

EXAMPLE II

Preparation of Type V Titanyl Phthalocyanine:

Fifty grams of TiOPc Type I were dissolved in 300 milliliters of a trifluoroacetic acid/methylene chloride (1/4, volume/volume) mixture for 1 hour in a 500 milliliter Erlenmeyer flask with magnetic stirrer. At the same time, 2,600 milliliters of methanol/methylene chloride (1/1, volume/volume) quenching mixture was cooled with a dry ice bath for 1 hour in a 3,000 milliliter beaker with magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose vacuum filtered through a 2,000 milliliter Buchner funnel with fibrous glass frit of about 4 to about 8 μm in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below 10 μS. The resulting wet cake contained approximately 50 weight percent of water. A small portion of the wet cake was dried at 65° C. under vacuum and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle, and rolled for an hour. The dispersion was vacuum filtered through a 2,000 milliliter Buchner funnel with a fibrous glass frit of about 4 to about 8 μm in porosity over a period of two hours. The pigment was then well mixed with 1,500 milliliters of methanol and filtered in the funnel twice. The final pigment was vacuum dried at 60° C. to 65° C. for two days. Approximately 45 grams of the pigment were obtained. The XRPD of the resulting pigment after the MCB conversion was designated as a Type V titanyl phthalocyanine. The Type V had an X-ray diffraction pattern having characteristic diffraction peaks at a Bragg angle of 2Θ±0.2° at about 9.0°, 9.6°, 24.0°, and 27.2°.

COMPARATIVE EXAMPLE 1

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) or Polycarbonate Z, weight average molecular weight of 20,000, available from Mitsubishi Gas Chemical Corporation, and 50 milliliters of monochlorobenzene into a 4 ounce glass bottle. To this solution were added 2.4 grams of titanyl phthalocyanine (TiOPc, Type V) of Example II and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of monochlorobenzene, and added to the titanyl phthalocyanine dispersion. This slurry was then placed on a shaker for 10 minutes. The resulting dispersion was, thereafter, applied to the above adhesive interface with a Bird applicator to form a photogenerating layer having a wet thickness of 0.50 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.8 micron.

The photoconductor web was then coated with a charge transport layer. Specifically, the photogenerating layer was overcoated with a charge transport layer in contact with the photogenerating layer. The charge transport layer was prepared by introducing into an amber glass bottle in a weight ratio of 50/50, N,N'-bis(methylphenyl)-1,1-biphenyl-4,4'-diamine (TBD) and poly(4,4'-isopropylidene diphenyl)carbonate, a known bisphenol A polycarbonate having a $M_w$ molecular weight average of about 120,000, commercially available from Farbenfabriken Bayer A. G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent.

COMPARATIVE EXAMPLE 2

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) or Polycarbonate Z, weight average molecular weight of 20,000, available from Mitsubishi Gas Chemical Corporation, and 50 milliliters of tetrahydrofuran (THF) into a 4 ounce glass bottle. To this solution were added 2.4 grams of hydroxygallium phthalocyanine (HOGaPc, Type V) and 300 grams of ⅛ inch (3.2 millimeter) diameter stainless steel shot. This mixture was then placed on a ball mill for 8 hours. Subsequently, 2.25 grams of PCZ-200 were dissolved in 46.1 grams of THF, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.50 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.8 micron.

The photoconductor web was then coated with a charge transport layer. Specifically, the photogenerating layer was overcoated with a charge transport layer in contact with the photogenerating layer. The charge transport layer was prepared by introducing into an amber glass bottle in a weight ratio of 50/50, N,N'-bis(methylphenyl)-1,1-biphenyl-4,4'-diamine (TBD) and poly(4,4'-isopropylidene diphenyl)carbonate, a known bisphenol A polycarbonate having a $M_w$ molecular weight average of about 120,000, commercially available from Farbenfabriken Bayer A. G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent.

EXAMPLE III

A photoconductor was prepared by repeating the process of Comparative Example 1 except that there was included in the photogenerating layer 3 weight percent of the polymeric additive obtained from CYTEC Corporation as CYASORB® UV-3529, a polymer containing a morpholine-2,4,6-trichloro-1,3,5-triazine, 1,6-hexanediamine, N,N'-bis(2,2,6,6-tetramethyl-4-piperidinyl) with a $M_w$ of about 1,700, and glass transition temperature ($T_g$) of about 88° C. The polymer was added to the prepared TiOPc photogenerating dispersion prior to the coating thereof on the supporting substrate.

EXAMPLE IV

A photoconductor was prepared by repeating the process of Comparative Example 2 except that there was included in the photogenerating layer 3 weight percent of the polymeric additive obtained from CYTEC Corporation as CYASORB® UV-3529, a polymer with morpholine-2,4,6-trichloro-1,3,5-triazine, 1,6-hexanediamine, N,N'-bis(2,2,6,6-tetramethyl-4-piperidinyl) with a $M_w$ of about 1,700, and glass transition temperature ($T_g$) of about 88° C. This polymer was added to the prepared HOGaPc photogenerating dispersion prior to the coating thereof on the supporting substrate.

EXAMPLE V

A photoconductor is prepared by repeating the process of Example III except that there is included in the photogenerating layer 5 weight percent of the additive CYASORB® UV-3346, poly[(6-morpholino-s-triazine-2,4-diyl)[(2,2,6,6-tetramethyl-4-piperidyl)imino]-hexamethylene[(2,2,6,6-tetramethyl-4-piperidyl)imino]] with a $M_w$ of about 1,600.

EXAMPLE VI

A photoconductor is prepared by repeating the process of Example III except that there is included in the photogenerating layer 10 weight percent of the additive 2-(4-biphenylyl)-4H-3,1-benzoxazinone.

EXAMPLE VII

A photoconductor is prepared by repeating the process of Example III except that there is included in the photogenerating layer 15 weight percent of the additive 1,3,5-tris(3-phenylquinoxalin-2-yl)benzene.

EXAMPLE VIII

A photoconductor is prepared by repeating the process of Example IV except that there is included in the photogenerating layer 15 weight percent of the additive 2,3,5,6-tetra(2-pyridyl)pyrazine.

EXAMPLE IX

A photoconductor is prepared by repeating the process of Example IV except that there is included in the photogenerating layer 5 weight percent of the additive 2-(2-benzoylphenyl)-4H-3,1-benzoxazinone.

Electrical Property Testing

The above prepared four photoconductors of Comparative Examples 1 and 2, and Examples III and IV were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductor devices were tested at surface potentials of 500 with the exposure light intensity incrementally increased by means of regulating a series of neutral density filters, and the exposure light source was a 780 nanometer light emitting diode. The xerographic simulation was completed in an environmentally controlled light tight chamber at ambient conditions (40 percent relative humidity and 22° C.).

For the two TiOPc photoconductors (Comparative Example 1 and Example III), almost identical PIDC curves were obtained. The incorporation of the additive did not adversely affect the electrical properties of the TiOPc photoconductors.

Similarly, for the two HOGaPc photoconductors (Comparative Example 2 and Example IV), almost identical PIDC curves were obtained. The incorporation of the additive did not adversely affect the electrical properties of the HOGaPc photoconductors.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member or photoconductor. The method of U.S. Pat. No. 5,703,487, designated as field-induced dark decay (FIDD), involves measuring either the differential increase in charge over and above the capacitive value, or measuring reduction in voltage below the capacitive value of a known imaging member and of a virgin imaging member, and comparing differential increase in charge over and above the capacitive value or the reduction in voltage below the capacitive value of the known imaging member and of the virgin imaging member.

U.S. Pat. Nos. 6,008,653 and 6,150,824, the disclosures of each patent being totally incorporated herein by reference, disclose a method for detecting surface potential charge patterns in an electrophotographic imaging member with a floating probe scanner. Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, and a floating fixture which maintains a substantially constant distance between the probe and the imaging surface. A constant voltage charge is applied to the imaging surface prior to relative movement of the probe and the imaging surface past each other, and the probe is synchronously biased to within about +/−300 volts of the average surface potential of the imaging surface to prevent breakdown, measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of about 20 volts can be selected to count charge deficient spots. The above four photoconductors were measured for CDS counts using the above-described FPS technique, and the results follow in Table 1.

TABLE 1

| | CDS (counts/cm$^2$) |
|---|---|
| Comparative Example 1 | 50 |
| Example III | 25 |
| Comparative Example 2 | 18 |
| Example IV | 8 |

The above data demonstrates that for the two TiOPc photoconductors, the CDS of the photoconductor of Example III was 25 counts/cm$^2$, and more specifically, only one half as compared to that of Comparative Example 1 of 50 counts/cm$^2$; for the two HOGaPc photoconductors, the CDS of the photoconductor of Example IV was 8 counts/cm$^2$, and more specifically, only one half of that as compared to Comparative Example 2 of 18 counts/cm$^2$.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer comprised of at least one charge transport component, and wherein said photogenerating layer contains a substituted amine oligomer.

2. A photoconductor in accordance with claim 1 wherein said substituted amine oligomer present in an amount of from about 0.5 to about 15 weight percent is represented by the following formulas/structures

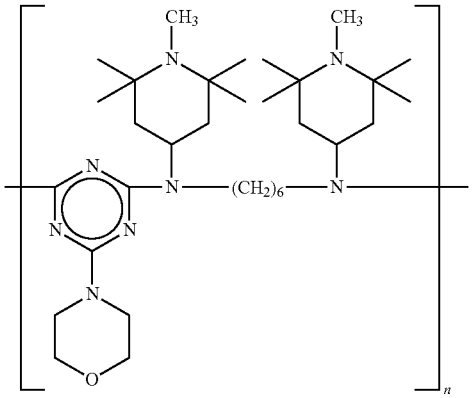

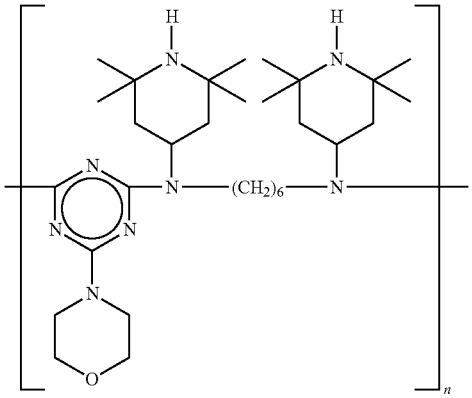

wherein n represents the number of segments of from about 1 to about 100, and mixtures thereof.

3. A photoconductor in accordance with claim 1 wherein said substituted amine oligomer is present in an amount of from about 0.1 to about 30 weight percent.

4. A photoconductor in accordance with claim 1 wherein said substituted amine oligomer is present in an amount of from about 0.5 to about 20 weight percent.

5. A photoconductor in accordance with claim 1 wherein said substituted amine oligomer is present in an amount of from about 1 to about 10 weight percent.

6. A photoconductor in accordance with claim 1 wherein said charge transport component is comprised of at least one of aryl amine molecules

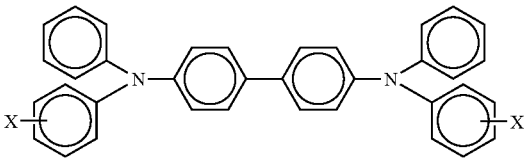

and

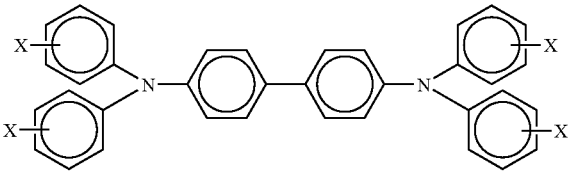

wherein X is selected from the group consisting of at least one of alkyl, alkoxy, aryl, and halogen.

7. A photoconductor in accordance with claim 6 wherein said alkyl and said alkoxy each contains from about 1 to about 12 carbon atoms, and said aryl contains from about 6 to about 36 carbon atoms.

8. A photoconductor in accordance with claim 6 wherein said aryl amine is N,N'-diphenyl-N,N-bis(3-methylphenyl)-1,1'-biphenyl-4,4'-diamine, and said substituted amine oligomer present in an amount of from about 1 to about 10 weight percent is selected from the group consisting of morpholine-2,4,6-trichloro-1,3,5-triazine, 1,6-hexanediamine, N,N'-bis(2,2,6,6-tetramethyl-4-piperidinyl) and [(6-morpholino-s-triazine-2,4-diyl)[(2,2,6,6-tetramethyl-4-piperidyl)imino]-hexamethylene[(2,2,6,6-tetramethyl-4-piperidyl)imino]].

9. A photoconductor in accordance with claim 1 wherein said charge transport component is comprised of

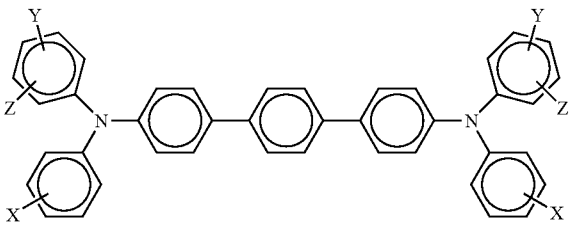

wherein X, Y and Z are independently selected from the group consisting of at least one of alkyl, alkoxy, aryl, and halogen; and wherein at least one of Y and Z are present.

10. A photoconductor in accordance with claim 9 wherein alkyl and alkoxy each contains from about 1 to about 12 carbon atoms, and aryl contains from about 6 to about 36 carbon atoms.

11. A photoconductor in accordance with claim 1 wherein said charge transport component is an aryl amine selected from the group consisting of N,N'-bis(4-butylphenyl)-N,N'- di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures thereof.

12. A photoconductor in accordance with claim 1 further including in at least one of said charge transport layers an antioxidant comprised of at least one of a hindered phenolic and a hindered amine.

13. A photoconductor in accordance with claim 1 wherein said photogenerating layer is comprised of at least one photogenerating pigment.

14. A photoconductor in accordance with claim 13 wherein said photogenerating pigment is comprised of at least one of a metal phthalocyanine, a metal free phthalocyanine and a perylene.

15. A photoconductor in accordance with claim 13 wherein said photogenerating pigment is comprised of a titanyl phthalocyanine.

16. A photoconductor in accordance with claim 13 wherein said photogenerating pigment is comprised of a hydroxygallium phthalocyanine.

17. A photoconductor in accordance with claim 13 wherein said photogenerating pigment is comprised of a chlorogallium phthalocyanine

18. A photoconductor in accordance with claim 13 wherein said photogenerating pigment is comprised of a bis(benzimidazo)perylene.

19. A photoconductor in accordance with claim 1 further including a hole blocking layer, and an adhesive layer.

20. A photoconductor in accordance with claim 1 wherein said substrate is a flexible web.

21. A photoconductor in accordance with claim 1 wherein said at least one charge transport layer is from 1 to about 7 layers.

22. A photoconductor in accordance with claim 1 wherein said at least one charge transport layer is from 1 to about 2 layers.

23. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer.

24. A photoconductor in accordance with claim 1 wherein the substrate is comprised of a conductive material.

25. A photoconductor consisting essentially of and in sequence of a supporting substrate, a photogenerating layer comprised of at least one photogenerating pigment and a component present in an amount of from about 1 to about 10 weight percent based on the weight percent of the components in the photogenerating layer, and which component is represented by the following formulas/structures and wherein n is from about 2 to about 10

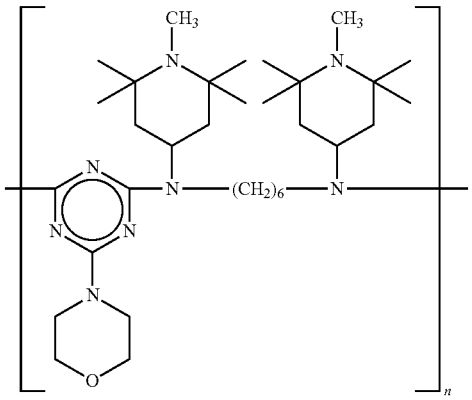

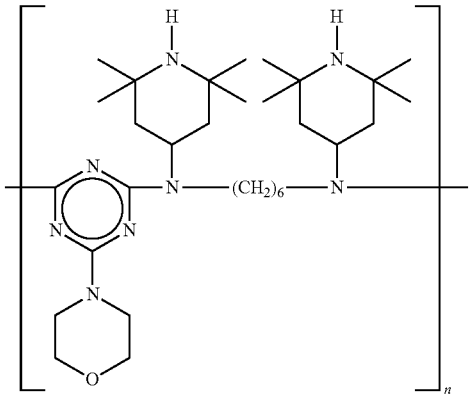

and a charge transport layer.

26. A photoconductor in accordance with claim 25 wherein said photogenerating layer component is a substituted amine oligomer of a morpholine-2,4,6-trichloro-1,3,5-triazine, 1,6-hexanediamine, N,N'-bis(2,2,6,6-tetramethyl-4-piperidinyl), and [(6-morpholino-s-triazine-2,4-diyl)[(2,2,6,6-tetramethyl-4-piperidyl)imino]-hexamethylene [(2,2,6,6-tetramethyl-4-piperidyl)imino]], and which is present in an amount of from about 1 to about 7 weight percent.

27. A photoconductor in accordance with claim 25 wherein the charge transport layer is comprised of hole transport molecules and a resin binder, said photogenerating pigment is a titanyl phthalocyanine prepared by dissolving a Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine, and treating said Type Y titanyl phthalocyanine with a monohalobenzene, and wherein said photoconductor contains a supporting substrate.

28. A photoconductor in accordance with claim 27 wherein said solution comprising an alcohol and an alkylene halide has an alcohol to alkylene halide ratio of from about 1/4 (v/v) to about 4/1 (v/v), and said titanyl phthalocyanine is Type V titanyl phthalocyanine, and wherein the resulting Type V titanyl phthalocyanine has an X-ray diffraction pattern having characteristic diffraction peaks at a Bragg angle 2Θ±0.2° at about 9.0°, 9.6°, 24.0°, and 27.2°.

29. A photoconductor comprising a supporting substrate, a photogenerating layer, and a hole transport layer, and wherein said photogenerating layer comprises a high sensitivity titanyl phthalocyanine and a substituted amine oligomer as represented by the following formulas/structures wherein n represents a number of from about 2 to about 20
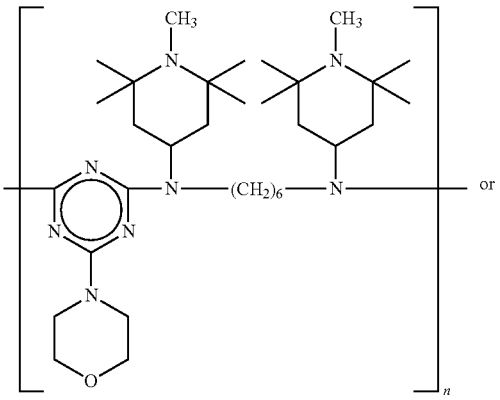
or
-continued
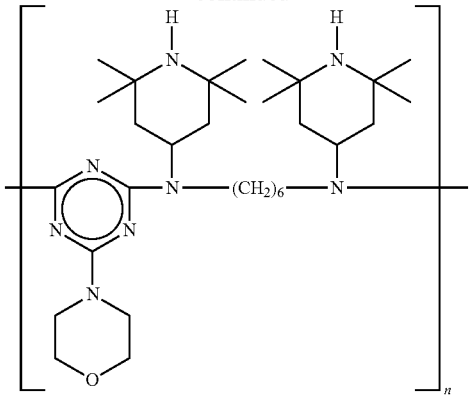
and wherein said substituted amine oligomer is present in an amount of from about 1 to about 10 weight percent.
* * * * *